US012123152B2

(12) United States Patent
Ligman

(10) Patent No.: US 12,123,152 B2
(45) Date of Patent: Oct. 22, 2024

(54) SIDE-STEP CONCRETE SCREEDING APPARATUS

(71) Applicant: Ligchine International Corporation, Floyds Knobs, IN (US)

(72) Inventor: Peter A. Ligman, Darien, WI (US)

(73) Assignee: Ligchine International Corporation, Floyds Knobs, IN (US)

( * ) Notice: Subject to any disclaimer, the term of this patent is extended or adjusted under 35 U.S.C. 154(b) by 782 days.

(21) Appl. No.: 17/360,565

(22) Filed: Jun. 28, 2021

(65) Prior Publication Data

US 2022/0162814 A1 May 26, 2022

Related U.S. Application Data

(63) Continuation-in-part of application No. 15/332,569, filed on Oct. 24, 2016, now abandoned.

(60) Provisional application No. 62/245,718, filed on Oct. 23, 2015.

(51) Int. Cl.
*E01C 19/42* (2006.01)

(52) U.S. Cl.
CPC ..... *E01C 19/42* (2013.01); *E01C 2301/16* (2013.01)

(58) Field of Classification Search
None
See application file for complete search history.

(56) References Cited

U.S. PATENT DOCUMENTS

| | | | |
|---|---|---|---|
| 1,284,385 | A | 11/1918 | Linden |
| 1,731,231 | A | 10/1929 | Chenoweth |
| 2,116,816 | A | 5/1938 | Kaspar |
| 2,403,812 | A | 7/1946 | Maccallum |
| 2,636,290 | A | 4/1953 | Bell |
| 3,341,029 | A | 9/1967 | Barkley et al. |
| 3,377,933 | A | 4/1968 | Dale |
| 3,675,721 | A | 7/1972 | Davidson et al. |
| 3,721,054 | A | 3/1973 | Hornagold |
| 3,749,504 | A | 7/1973 | Smith |
| 3,840,125 | A | 10/1974 | Cozad |
| 3,870,427 | A | 3/1975 | Allen |
| 3,901,616 | A | 8/1975 | Greening |
| 3,953,052 | A | 4/1976 | Palmcrantz |
| 3,966,345 | A | 6/1976 | Kofel |

(Continued)

FOREIGN PATENT DOCUMENTS

| | | |
|---|---|---|
| AU | 2019359107 | 5/2021 |
| AU | 2019357862 | 6/2021 |

(Continued)

OTHER PUBLICATIONS

U.S. Appl. No. 18/414,213, filed Jan. 16, 2024 titled Concrete Screed with Vision System.

(Continued)

*Primary Examiner* — Thomas B Will
*Assistant Examiner* — Katherine J Chu
(74) *Attorney, Agent, or Firm* — Dinsmore & Shohl LLP

(57) ABSTRACT

An apparatus for screeding concrete to produce a level finished surface includes a frame assembly having a pair of spaced vertically oriented stabilization legs secured to the front end thereof supporting a generally horizontal front member. An extendable boom assembly is secured to said frame assembly at a first end and to a screed head at a second end. A side-step assembly includes an actuator with an extendable arm secured to said boom assembly to impart generally lateral motion.

4 Claims, 8 Drawing Sheets

(56) References Cited

U.S. PATENT DOCUMENTS

| | | | |
|---|---|---|---|
| 3,969,035 | A | 7/1976 | Silbernagel |
| 3,970,405 | A | 7/1976 | Swisher |
| 4,029,165 | A | 6/1977 | Miller |
| 4,036,372 | A | 7/1977 | Rao et al. |
| 4,084,777 | A | 4/1978 | Lambert |
| 4,192,626 | A | 3/1980 | Wyckoff |
| 4,231,678 | A | 11/1980 | Carternock |
| 4,363,409 | A | 12/1982 | Laurich-Trost |
| 4,406,375 | A | 9/1983 | Hockensmith |
| 4,422,795 | A | 12/1983 | Berrange |
| 4,566,823 | A | 1/1986 | May |
| 4,655,633 | A | 4/1987 | Somero et al. |
| 4,700,786 | A | 10/1987 | Berry |
| 4,770,304 | A | 9/1988 | Woods |
| 4,789,266 | A | 12/1988 | Clarke, Jr. |
| 4,869,618 | A | 9/1989 | Morrison |
| 4,896,995 | A | 1/1990 | Simmons |
| 4,930,935 | A | 6/1990 | Quenzie et al. |
| 4,936,763 | A | 6/1990 | Thomas |
| 4,978,246 | A | 12/1990 | Quenzi et al. |
| 4,988,233 | A | 1/1991 | Kasler |
| 5,009,546 | A | 4/1991 | Domenighetti et al. |
| 5,018,555 | A | 5/1991 | Hawerkamp |
| 5,039,249 | A | 8/1991 | Hansen et al. |
| 5,045,025 | A | 9/1991 | Underwood |
| 5,051,025 | A | 9/1991 | Taylor, Jr. |
| 5,120,186 | A | 6/1992 | Jorgenson |
| 5,129,803 | A | 7/1992 | Nomura |
| 5,192,102 | A | 3/1993 | Mertens |
| 5,217,320 | A | 6/1993 | Cioffi |
| 5,224,793 | A | 7/1993 | De Pol |
| 5,234,128 | A | 8/1993 | Hill |
| 5,234,281 | A | 8/1993 | Somero et al. |
| 5,244,305 | A | 9/1993 | Lindley |
| 5,348,418 | A | 9/1994 | Campbell |
| 5,360,097 | A | 11/1994 | Hibbs |
| 5,375,942 | A | 12/1994 | Lindley et al. |
| 5,515,654 | A | 5/1996 | Anderson |
| 5,533,831 | A | 7/1996 | Allen |
| 5,556,226 | A | 9/1996 | Hohmann, Jr. |
| 5,567,075 | A | 10/1996 | Allen |
| 6,129,481 | A | 10/2000 | Tapio et al. |
| 6,155,708 | A | 12/2000 | Lindley |
| 6,203,244 | B1 | 3/2001 | Van Ornum |
| 6,227,761 | B1 | 5/2001 | Kieranen |
| 6,325,531 | B1 | 12/2001 | Lindley |
| 6,328,115 | B1 | 12/2001 | Carter, Jr. |
| 6,447,204 | B1 | 9/2002 | McDonald |
| 6,481,924 | B1 | 11/2002 | Smolders et al. |
| 6,485,227 | B1 | 11/2002 | Mathiowetz |
| 6,508,606 | B1 | 1/2003 | James |
| 6,530,721 | B2 | 3/2003 | Yost |
| 6,554,532 | B1 | 4/2003 | Motz |
| 6,695,532 | B2 | 2/2004 | Somero et al. |
| 6,729,796 | B1 | 5/2004 | Green |
| 6,843,615 | B1 | 1/2005 | Cook |
| 6,857,816 | B2 | 2/2005 | Saito et al. |
| 6,860,676 | B2 | 3/2005 | Pont Feixes |
| 6,976,454 | B2 | 12/2005 | Cattaruzzi |
| 7,004,675 | B2 | 2/2006 | Wayne |
| 7,044,681 | B2 | 5/2006 | Quenzie et al. |
| 7,121,762 | B2 | 10/2006 | Quenzie et al. |
| 7,144,191 | B2 | 12/2006 | Kieranen et al. |
| 7,172,363 | B2 | 2/2007 | Olson et al. |
| 7,175,363 | B2 | 2/2007 | Quenzie et al. |
| 7,195,423 | B2 | 3/2007 | Halonen et al. |
| 7,195,424 | B2 | 3/2007 | Lindley |
| 7,232,277 | B2 | 6/2007 | Corbitt |
| 7,311,466 | B2 | 12/2007 | Torvinen |
| 7,320,558 | B2 | 1/2008 | Quenzie |
| 7,328,810 | B1 | 2/2008 | Rhodes |
| 7,396,186 | B2 | 7/2008 | Quenzie et al. |
| 7,399,139 | B2 | 7/2008 | Kieranen et al. |
| 7,407,339 | B2 | 8/2008 | Halonen et al. |
| 7,497,140 | B2 | 3/2009 | Blackwelder et al. |
| 7,540,685 | B2 | 6/2009 | Avikainen |
| 7,540,686 | B2 | 6/2009 | Heims |
| 7,540,687 | B2 | 6/2009 | Neumann |
| 7,559,719 | B2 | 7/2009 | Nasby |
| 7,621,694 | B1 | 11/2009 | Goodman et al. |
| 7,685,929 | B2 | 3/2010 | Mainville |
| 7,748,789 | B2 | 7/2010 | Freeburn |
| 7,775,742 | B2 | 8/2010 | Buijsman |
| 7,850,396 | B2 | 12/2010 | Pietila et al. |
| 7,854,565 | B2 | 12/2010 | Halonen et al. |
| 7,874,571 | B2 | 1/2011 | Frey |
| 7,891,479 | B2 | 2/2011 | Evangelista |
| 7,909,533 | B2 | 3/2011 | Quenzi |
| 8,128,390 | B2 | 3/2012 | O'Hara |
| 8,152,409 | B1 | 4/2012 | Ligman |
| 8,220,806 | B2 | 7/2012 | Neudeck |
| 8,322,947 | B2 | 12/2012 | Neumann |
| 8,591,142 | B2 | 11/2013 | Mittleman |
| 8,657,215 | B1 | 2/2014 | Blum |
| 8,794,868 | B2 | 8/2014 | Fritz |
| 9,180,909 | B1 | 11/2015 | Coats |
| 9,199,828 | B2 | 12/2015 | Steinich |
| 9,297,171 | B1 | 3/2016 | Ligman |
| 9,316,343 | B2 | 4/2016 | O'Hara |
| 9,404,272 | B1 | 8/2016 | Ligman |
| 9,428,869 | B2 | 8/2016 | Pedersen |
| 9,493,914 | B2 | 11/2016 | Kaiser |
| 9,708,780 | B1 | 7/2017 | Ligman |
| 9,909,267 | B1 | 3/2018 | Ligman |
| 10,233,658 | B1 | 3/2019 | Ligman |
| 10,494,776 | B2 | 12/2019 | Pietila |
| 10,794,016 | B2 | 10/2020 | McKinnon |
| 10,914,051 | B2 | 2/2021 | Keigley |
| 11,162,232 | B2 | 11/2021 | Ligman |
| 2002/0015618 | A1 | 2/2002 | Quenzi et al. |
| 2002/0127058 | A1 | 9/2002 | Quenzi et al. |
| 2003/0161684 | A1 | 8/2003 | Quenzi et al. |
| 2004/0009038 | A1 | 1/2004 | Roth |
| 2004/0076472 | A1 | 4/2004 | Holmes |
| 2004/0154237 | A1 | 8/2004 | Mainville |
| 2005/0141963 | A1 | 6/2005 | Holmes |
| 2005/0207843 | A1 | 9/2005 | Jackson |
| 2005/0263302 | A1 | 12/2005 | Newnam |
| 2006/0018715 | A1 | 1/2006 | Halonen |
| 2006/0120801 | A1 | 6/2006 | Johnson |
| 2006/0216114 | A1 | 9/2006 | Quenzie |
| 2007/0031191 | A1 | 2/2007 | Quenzie et al. |
| 2007/0116520 | A1 | 5/2007 | Quenzi et al. |
| 2007/0127985 | A1 | 6/2007 | Halonen et al. |
| 2007/0140792 | A1 | 6/2007 | Quenzie et al. |
| 2007/0154260 | A1 | 7/2007 | Lindley |
| 2008/0135375 | A1 | 6/2008 | Pettijohn |
| 2008/0253221 | A1 | 10/2008 | Lindley |
| 2010/0008750 | A1 | 1/2010 | Jones |
| 2010/0183369 | A1 | 7/2010 | Lindley |
| 2010/0215433 | A1 | 8/2010 | Fritz |
| 2010/0266339 | A1 | 10/2010 | Guntert |
| 2010/0296868 | A1 | 11/2010 | Braun |
| 2011/0236129 | A1 | 9/2011 | Guntert |
| 2011/0266774 | A1 | 11/2011 | Gregg |
| 2012/0183350 | A1 | 7/2012 | Mittleman |
| 2013/0294834 | A1 | 11/2013 | Pai |
| 2013/0333253 | A1 | 12/2013 | Noel |
| 2014/0169881 | A1 | 6/2014 | Hagen |
| 2014/0331632 | A1 | 11/2014 | Schots |
| 2014/0363232 | A1 | 12/2014 | Pietila |
| 2015/0093193 | A1 | 4/2015 | Zimmermann |
| 2015/0258926 | A1 | 9/2015 | Wick |
| 2015/0367388 | A1 | 12/2015 | Wang |
| 2016/0009507 | A1 | 1/2016 | Wiseman |
| 2016/0177519 | A1 | 6/2016 | Fritz |
| 2016/0245917 | A1 | 8/2016 | Schoonmaker |
| 2017/0218576 | A1 | 8/2017 | Lindley |
| 2017/0218577 | A1 | 8/2017 | Lindley |
| 2018/0327982 | A1 | 11/2018 | Leukuma |
| 2018/0334332 | A1 | 11/2018 | Eberts |
| 2020/0010006 | A1 | 1/2020 | Wilson |
| 2020/0109525 | A1 | 4/2020 | Ligman |
| 2020/0109526 | A1 | 4/2020 | Ligman |

(56) References Cited

U.S. PATENT DOCUMENTS

| | | | |
|---|---|---|---|
| 2020/0109573 | A1 | 4/2020 | Ligman |
| 2020/0248413 | A1 | 8/2020 | Wolf |
| 2020/0263367 | A1 | 8/2020 | Berning |
| 2020/0290494 | A1 | 9/2020 | Key |
| 2020/0346254 | A1 | 11/2020 | Opatril |
| 2020/0392675 | A1 | 12/2020 | Guntert, Jr. |
| 2020/0399071 | A1 | 12/2020 | Wilson |
| 2021/0053766 | A1 | 2/2021 | Bacon-Maldonado |
| 2021/0131046 | A1 | 5/2021 | Hirman |
| 2021/0139246 | A1 | 5/2021 | Wilson |
| 2022/0049436 | A1 | 2/2022 | Ligman |

FOREIGN PATENT DOCUMENTS

| | | | |
|---|---|---|---|
| AU | 2019358780 | | 6/2021 |
| CA | 2272485 | | 11/2000 |
| CN | 113525557 | | 10/2021 |
| EP | 1256657 | | 11/2002 |
| EP | 1267000 | A2 | 12/2002 |
| EP | 3864236 | | 8/2021 |
| EP | 3864237 | | 8/2021 |
| EP | 3864238 | | 8/2021 |
| ES | 2247952 | A1 | 3/2006 |
| GB | 2246997 | | 2/1992 |
| WO | 2006133490 | A1 | 12/2006 |
| WO | WO 2019133917 | | 7/2019 |
| WO | WO 2020009821 | | 1/2020 |
| WO | 2020076468 | | 4/2020 |
| WO | 2020076469 | | 4/2020 |
| WO | 2020076470 | | 4/2020 |
| WO | WO 2020148632 | | 7/2020 |
| WO | WO 2020150808 | | 7/2020 |
| WO | WO 2022182755 | | 9/2022 |
| WO | WO 2023278421 | | 1/2023 |
| WO | WO2023076906 | A1 | 5/2023 |

OTHER PUBLICATIONS

U.S. Appl. No. 18/414,177, filed Jan. 16, 2024 titled Electric Apparatus for Screeding Concrete.
PCT Patent Application No. PCT/US2024/011682 filed Jan. 15, 2024 titled Electric Apparatus for Screeding Concrete.
European Patent Office International Report on Patentability issued in PCT/US2022/035287 mailed Jan. 11, 2024.
European Patent Office: Intention to Grant issued in EP Application No. 19780088.1 mailed Dec. 4, 2023.
European Patent Office: Intention to Grant issued in EP Application No. 19779704.6 mailed Dec. 4, 2023.
European Patent Office: Intention to Grant issued in EP Application No. 19779340.9 mailed Dec. 11, 2023.
European Patent Office; International Search Report and Written Opinion for PCT App. No. PCT/US2022/017515 mailed May 12, 2022.
European Patent Office; International Search Report and Written Opinion for PCT App. No. PCT/US2022/035287 mailed Oct. 21, 2022.
European Patent Office; International Search Report and Written Opinion for PCT App. No. PCT/US2022/078664 mailed Feb. 10, 2023.
European Patent Office; International Search Report and Written Opinion issued in PCT/US2024/011682 mailed May 16, 2024.
International Bureau of WIPO; International Preliminary Report on Patentability issued in PCT/US2022/078664 issued Apr. 30, 2024 and mailed May 10, 2024.
U.S. Appl. No. 18/315,925, filed May 11, 2023 titled Electronically Actuated Leveling System for Screeding Concrete.
U.S. Appl. No. 18/322,962, filed May 24, 2023 titled Swing Boom Concrete Screeding Apparatus.
European Patent Office; International Search Report and Written Opinion for PCT App. No. PCT/US2019/051694 dated Nov. 7, 2019.
European Patent Office; International Search Report and Written Opinion for PCT App. No. PCT/US2019/051695 dated Nov. 7, 2019.
European Patent Office; International Search Report and Written Opinion for PCT App. No. PCT/US2019/051698 dated Nov. 7, 2019.
Australian National Stage App. No. 2019357862 entered national stage on May 6, 2021 titled Apparatus for Screeding Concrete.
Australian National Stage App. No. 2019359107 entered national stage on May 6, 2021 titled Drive System for Screeding Concrete.
Australian National Stage App. No. 2019358780 entered national stage on May 6, 2021 titled Electronically Actuated Leveling System for Screeding Concrete.
European National Stage App. No. 19780088.1 entered national stage on Apr. 28, 2021 titled Apparatus for Screeding Concrete.
European National Stage App. No. 19779704.6 entered national stage on Apr. 28, 2021 titled Drive System for Screeding Concrete.
European National Stage App. No. 19779340.9 entered national stage on Apr. 28, 2021 titled Electronically Actuated Leveling System for Screeding Concrete.
European Patent Office Communication in app. No. 19780088.1 dated Jul. 21, 2021.
European Patent Office Communication in app. No. 19779704.6 dated Jul. 21, 2021.
European Patent Office Communication in app. No. 19779340.9 dated Jul. 21, 2021.

SIDE-STEP CONCRETE SCREEDING APPARATUS

BACKGROUND OF THE INVENTION

Field of the Invention

The present invention relates generally to a system and apparatus for leveling and finishing or "screeding" concrete and more specifically to a concrete screed apparatus for screeding a poured concrete surface that is capable of screeding around obstacles in the poured surface with minimal disruption in the screeding process. The concrete screed apparatus in accordance with the invention includes an adjustable and controllable screed head frame that is capable of generally lateral horizontal motion with respect to the poured surface, thereby providing the ability to move a screed head secured to the screed head frame around an obstacle without moving the entire apparatus to a new location.

Description of the Related Art

In the construction industry when liquid concrete is poured to produce a finished surface it must be quickly and carefully smoothed or screeded, so that when the concrete sets it produces an even, level surface. Since this level surface is almost always a foundation for additional construction, a machine base pad or foundation, or for mounting vertical storage such as warehousing and shelving space, it is highly desirable to produce a surface that is consistently level over its entire area. In large poured areas it is unwieldy and labor intensive to manually level and smooth a poured concrete surface as well as extremely difficult to maintain a consistent finished grade.

In order to aid in the screeding of large surface area concrete pours, a variety of concrete screed or troweling machines have been accepted into use in the art. These machines typically include a screed head comprising a flat troweling surface for contacting the poured concrete mounted on a boom that is mechanically extended and retracted across the concrete surface to produce a smooth surface finish. Many of these prior art devices include various systems for leveling the screed head relative to a reference plane such that the finished surface is relatively flat once it is screeded.

The leveling systems in prior art screed devices may encompass laser eyes mounted on the screed head structure that detect a laser beam projected at a predetermined level reference height above grade. Thus the screed head may be adjusted using a wide variety of adjustment mechanisms to a predetermined grade level by aligning said laser eyes with a projected laser beam. Furthermore, many of these devices provide automated systems for adjusting the screed head upwardly or downwardly to a level reference plane, thus obviating the need for manual alignment. In some systems, the automated adjustment of the screed head requires the use of multiple sensors and actuators along with the concomitant wiring and computerized control systems required to effect the necessary leveling adjustments.

Prior art screed devices often comprise a frame having a centrally mounted turret from which a boom is extended. Some systems comprise rigid frame structures from which a boom is extended. A screed head for smoothing the poured concrete is secured to the boom and leveled, using a wide variety of known leveling techniques, and is then retracted back across the poured concrete surface to achieve a smooth level finished surface. The leveling process for the screed head is typically a continuous process that maintains a level grade during the retraction of the boom.

However, one disadvantage to known concrete screed machines, often called "screeders", is their inability to be maneuvered around obstacles that may be located in the surface being finished. For example, almost all poured concrete surfaces have something extending upwardly through them. Support columns, conduits, heating and cooling ducts, plumbing chases, and decorative members are all examples of obstacles that may extend up through a poured concrete surface. Using prior art machines to finish these surfaces requires a great deal of hand finishing, since the screed head is difficult to move around the obstacle as it is being retracted.

Many prior art screed machines must be moved multiple times to make multiple passes around an obstacle, while a great deal of hand finishing is used near the obstacle to finish the poured area adjacent to it that cannot be reached by the screed machine. In fact, while many prior art screed devices are available, a great deal of concrete screeding is still accomplished by hand due to the size and lack of maneuverability of automated screed machines. Of course, hand finishing is slow and labor intensive, and thus adds expense to any concrete pour.

Accordingly, there is a need in the art for a system, method and apparatus for troweling concrete that provides a consistently level finished surface with the ability to maneuver the screed head used to contact and finish the surface quickly and easily around obstacles that may be located in a concrete pour.

It should be appreciated that all combinations of the foregoing concepts and additional concepts discussed in greater detail below (provided such concepts are not mutually inconsistent) are part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

Other features, objects and advantages of the present invention will become apparent from the detailed description of the drawing Figures taken in conjunction with the appended drawing Figures, wherein like reference characters generally refer to the same parts throughout the different view. The drawings are not necessarily to scale. Emphasis is instead generally placed upon illustrating the principles of the disclosure.

BRIEF DESCRIPTION OF THE DRAWING FIGURES

DETAILED DESCRIPTION OF THE PREFERRED EMBODIMENT(S)

Figure 1:
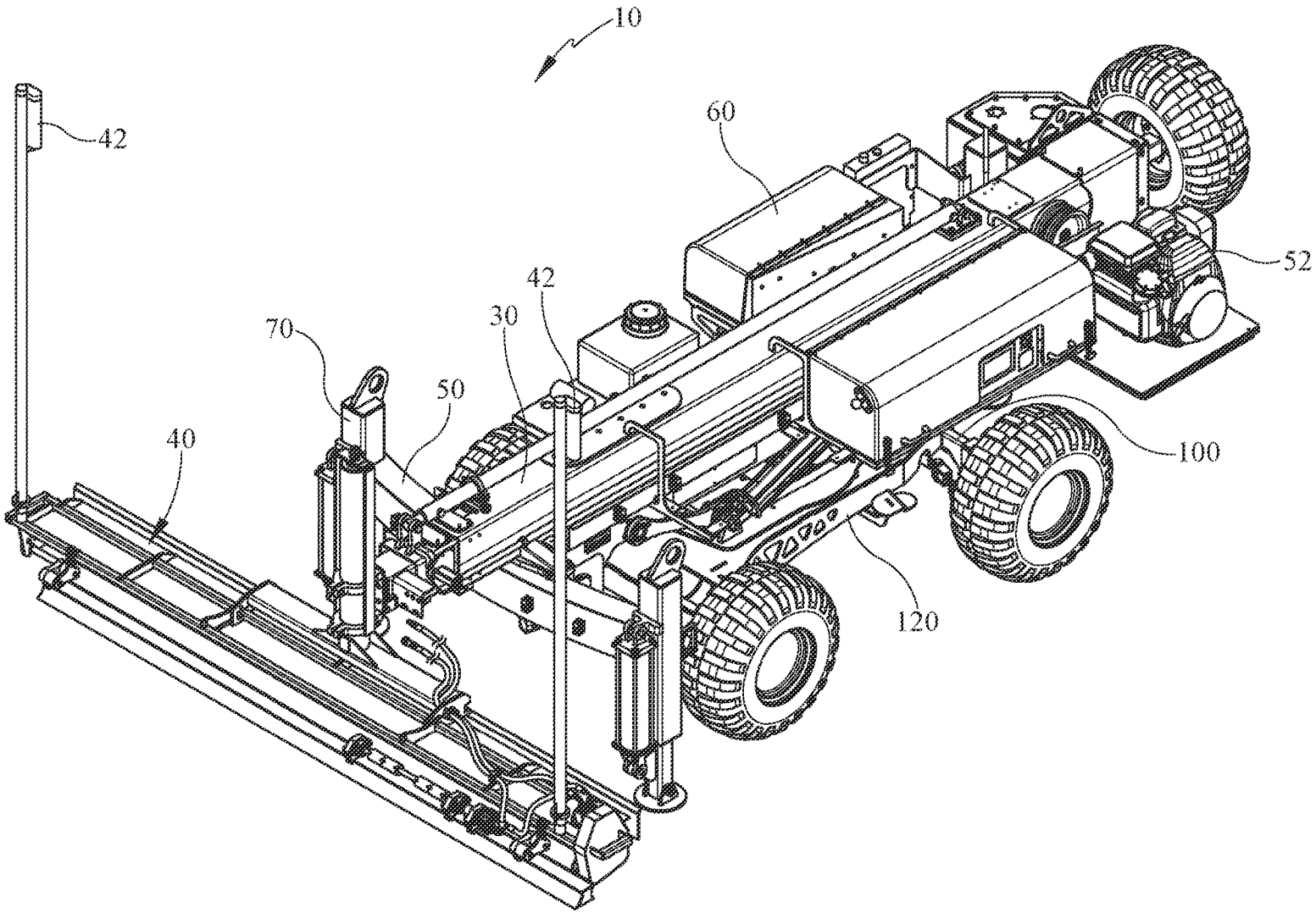
FIG. 1 is a perspective view of a concrete screeding apparatus in accordance with one embodiment of the present invention.
Figure 2:
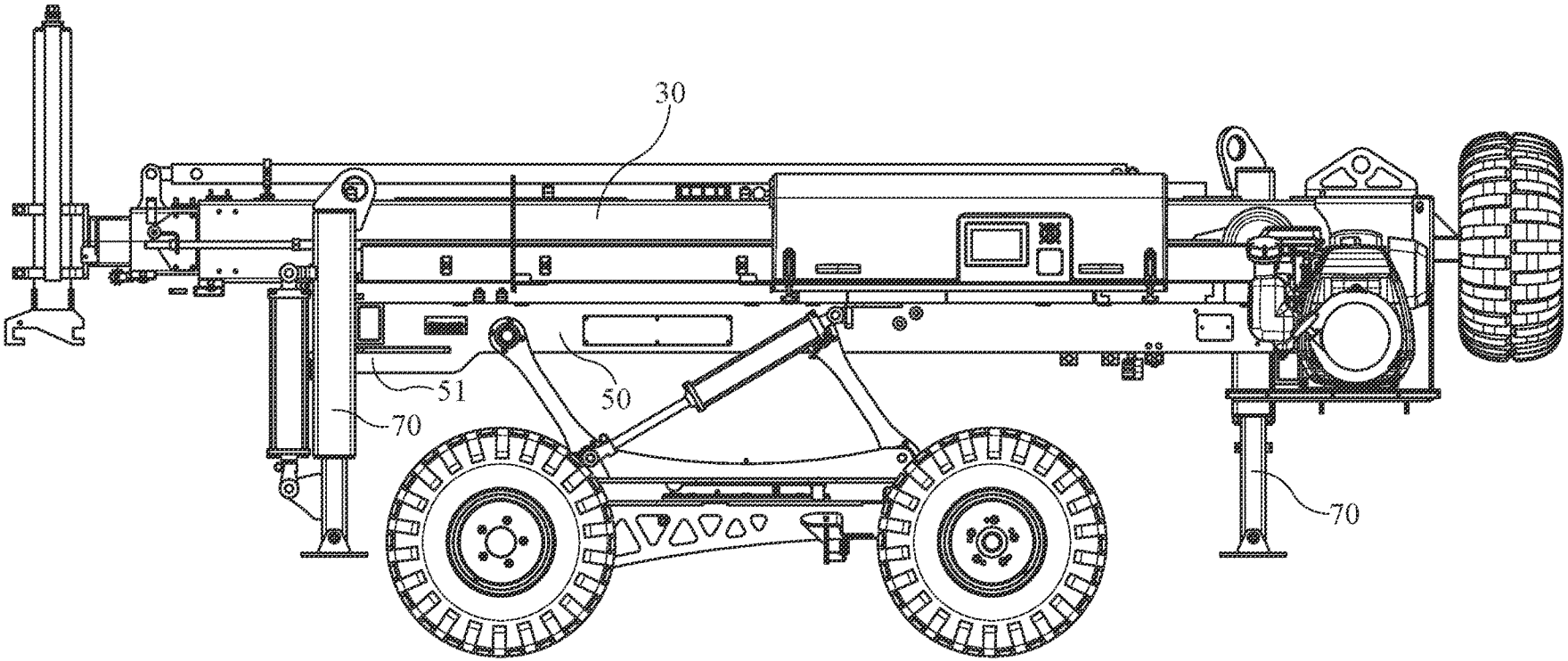
FIG. 2 is a side view of a concrete screeding apparatus in accordance with one embodiment of the present invention.

Referring now to drawing FIGS. 1-8, and in accordance with one non-limiting embodiment of the invention, the present invention overcomes the aforementioned difficulties in the prior art by providing a concrete screeding apparatus 10, known in the art as a screeder, having a telescopic boom assembly 30 and rigid frame assembly 50 that boom assembly 30 is adjustably secured thereto. One of ordinary skill in the art will recognize that a wide variety of frame assemblies 50 may be employed in the apparatus of the invention without departing from the scope thereof.

In some aspects of the invention, a conventional internal combustion engine 52 having an output shaft coupled to a hydraulic assembly 60 is provided, for supplying pressurized hydraulic fluid to a plurality of components necessary to operate screeder 10 via a plurality of electrically actuated control valves, as will be discussed in greater detail herein below.

The invention may further include a drive assembly 100 that is powered by pressurized hydraulic fluid, electric motors, or driven gear or chain systems as necessary to move screed apparatus 10. The drive 100 may be advantageously mounted on an undercarriage 120 such that it is rotatable with respect to frame 50, to allow screed apparatus 10 to be moved "sideways', or parallel to the direction of screeding for a concrete pour. This motion may also be described as lateral motion. Furthermore, drive assembly 100 and undercarriage 120 may in some aspects of the invention be rotatably mounted directly to rigid frame 50.

Referring again to FIGS. 1-3 boom assembly 30 may in certain embodiments be secured to a screed head 40 that operates to smooth and level a poured concrete surface, the screed head 40 having a plurality of leveling eyes 42 secured or appended thereto that are used to level boom assembly 30 with respect to a reference plane, thereby providing a level finished concrete surface as screed head 40 is retracted toward screed apparatus 10. In various embodiments of the present invention leveling eyes 42 may comprise laser transmitters that emit light that is received by a receiver (not shown), thereby providing the ability to adjust screed head 40 to a reference plane, as is known in the art.

In accordance with some embodiments of the present invention, a concrete screed apparatus 10 may include or incorporate a rigid frame assembly 50 on which a conventional internal combustion engine 52 is mounted. Engine 52 supplies power via a conventional output shaft to a hydraulic assembly 60, also mounted on frame assembly 50. Hydraulic assembly 60 may typically include a pump 62 for pressurizing hydraulic fluid and a plurality of electrically actuated control valves (not shown) for supplying pressurized hydraulic fluid to a plurality of components as discussed in detail below.

In various non-limiting aspects of the invention hydraulic assembly 60 may further comprise a control system (not shown) which may include a microprocessor, data memory, inputs and outputs, a wireless transceiver 64, and requisite wiring to electrically connect the control system to the plurality of valves. Furthermore, throughout the specification the operation of hydraulic cylinders will be understood to be effected through the use of a conventional hydraulic system 60, comprising electrically actuated hydraulic valves and a control system for operating said valves, as is known to one of ordinary skill in the art.

In further aspects of the invention a plurality of adjustable stabilization legs 70 are secured in a generally vertical orientation to frame assembly 50 at a plurality of points around the perimeter thereof. As shown in the drawing Figures, in one exemplary embodiment of the invention two opposed legs 70 are secured to frame assembly 50 at a forward end 51 thereof while a single leg 70 is secured to a rear end 53 of frame assembly 50. One of ordinary skill in the art will understand that the number and positioning of legs 70 around frame assembly 50 may be varied without departing from the scope of the present invention. Each leg 70 is further secured to a hydraulic cylinder 66 which is also secured to frame 50 at a point, and that is utilized to level boom assembly 30 with respect to a reference plane, thereby leveling entire screeding apparatus 10 as well as screed head 40. This feature of the instant invention provides an extremely level finished concrete surface, since boom 30 and screed head 40, once leveled, are unable to move with respect to a desired reference plane.

Figure 3:
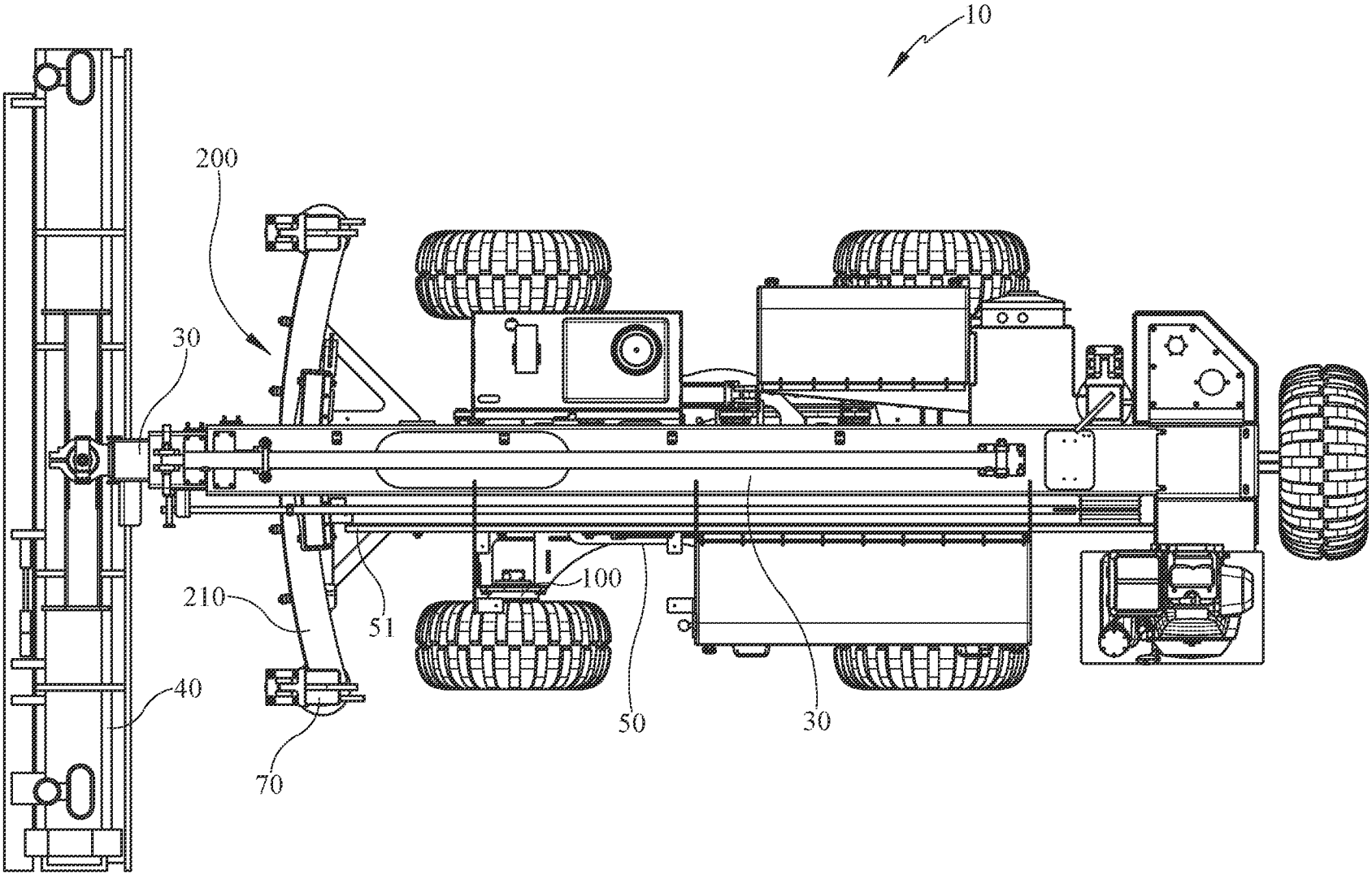
FIG. 3 is a top view of a concrete screeding apparatus in accordance with one embodiment of the present invention.
Figure 4:
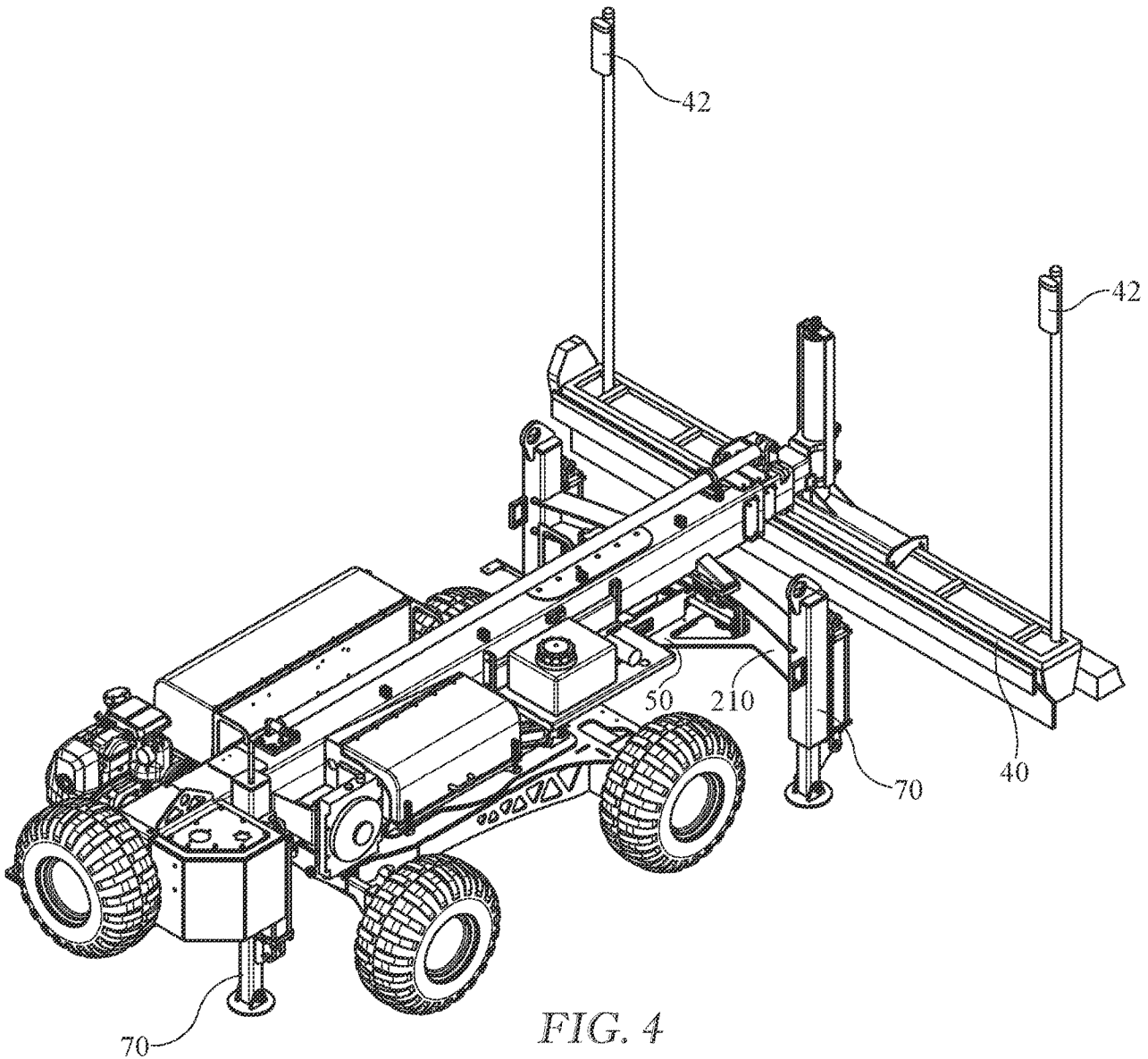
FIG. 4 is a perspective view of a concrete screeding apparatus in accordance with one embodiment of the present invention.
Figure 5:
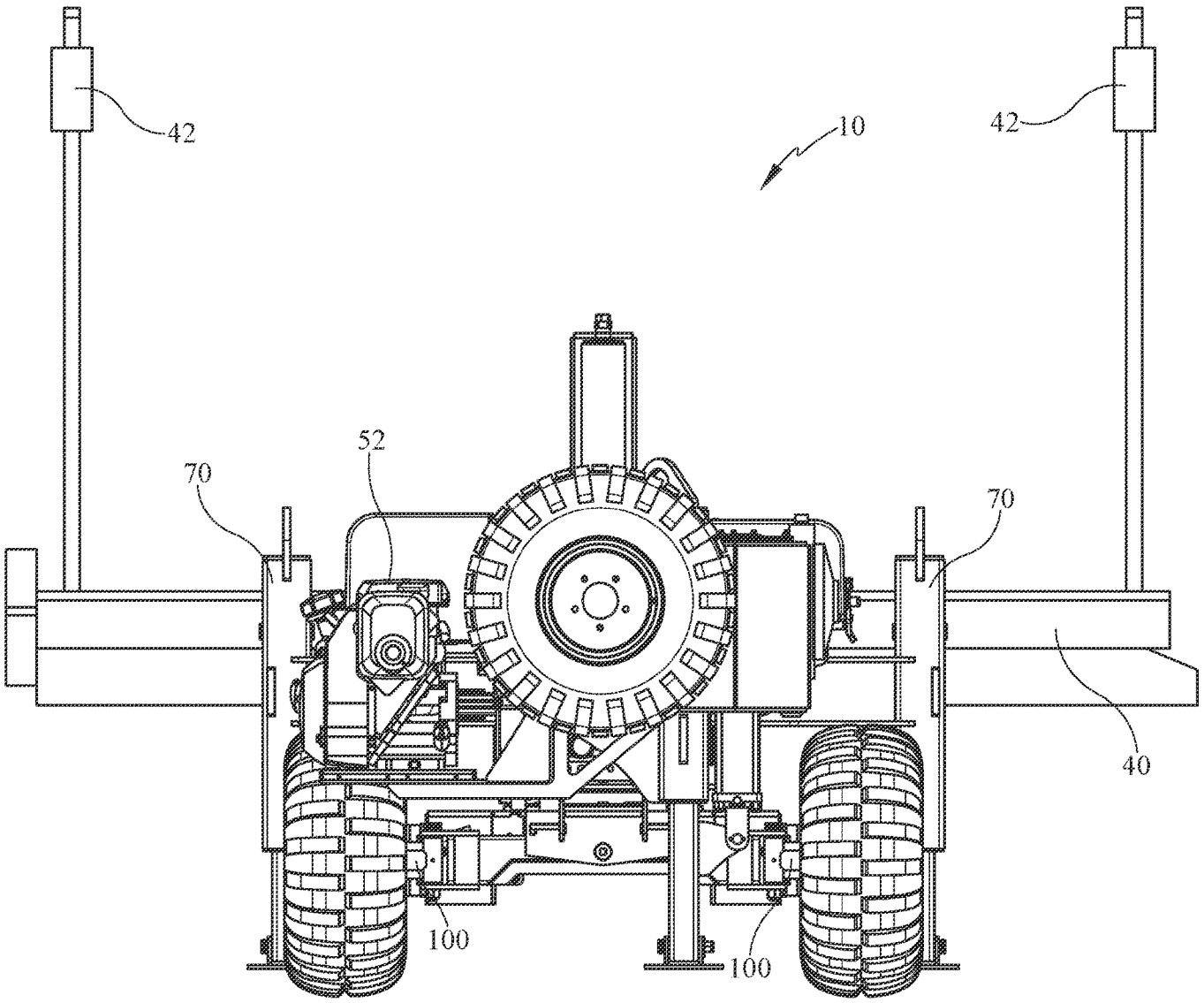
FIG. 5 is a rear view of a concrete screeding apparatus in accordance with one embodiment of the present invention.
Figure 6:
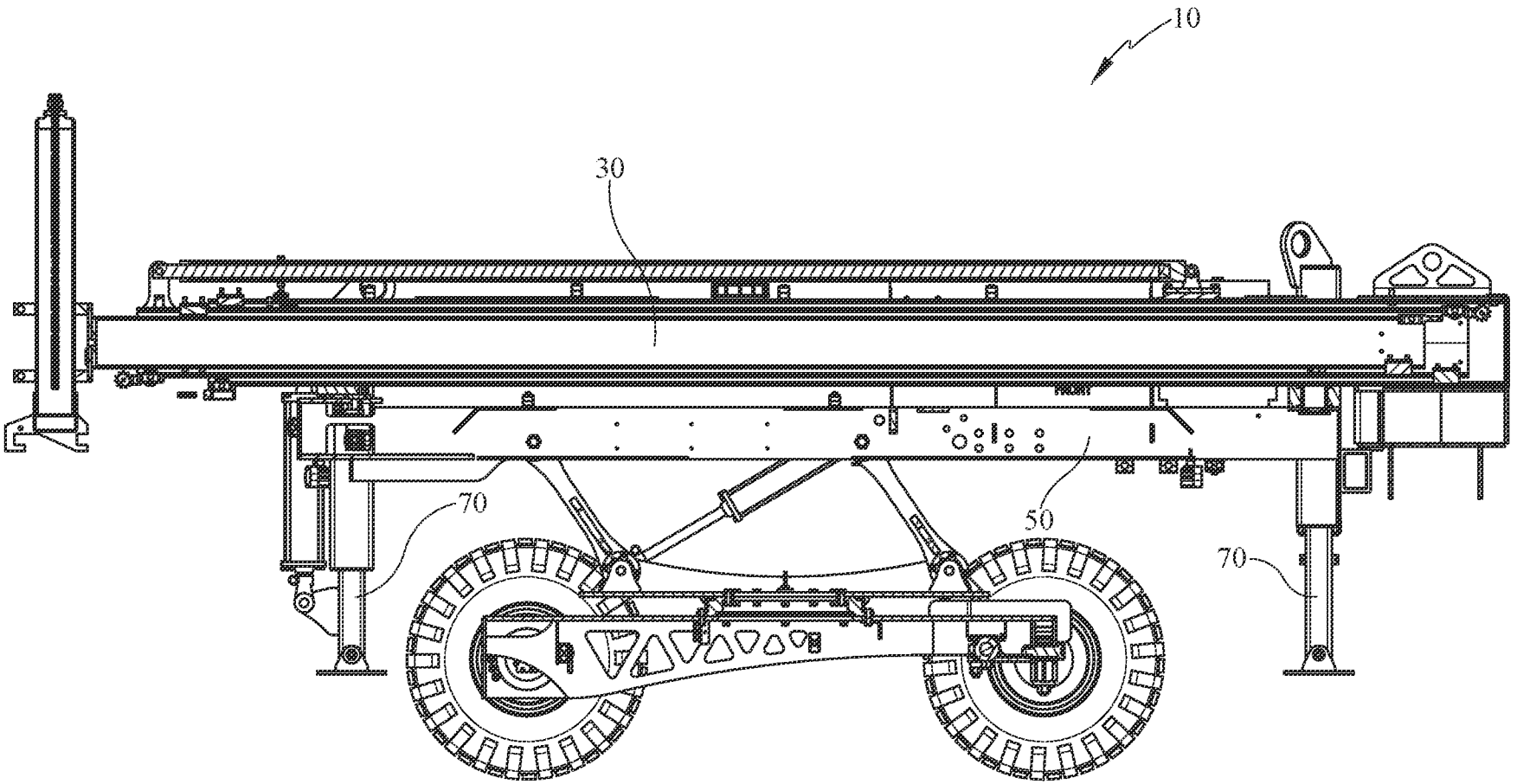
FIG. 6 is a side view of a concrete screeding apparatus in accordance with one embodiment of the present invention.
Figure 7:
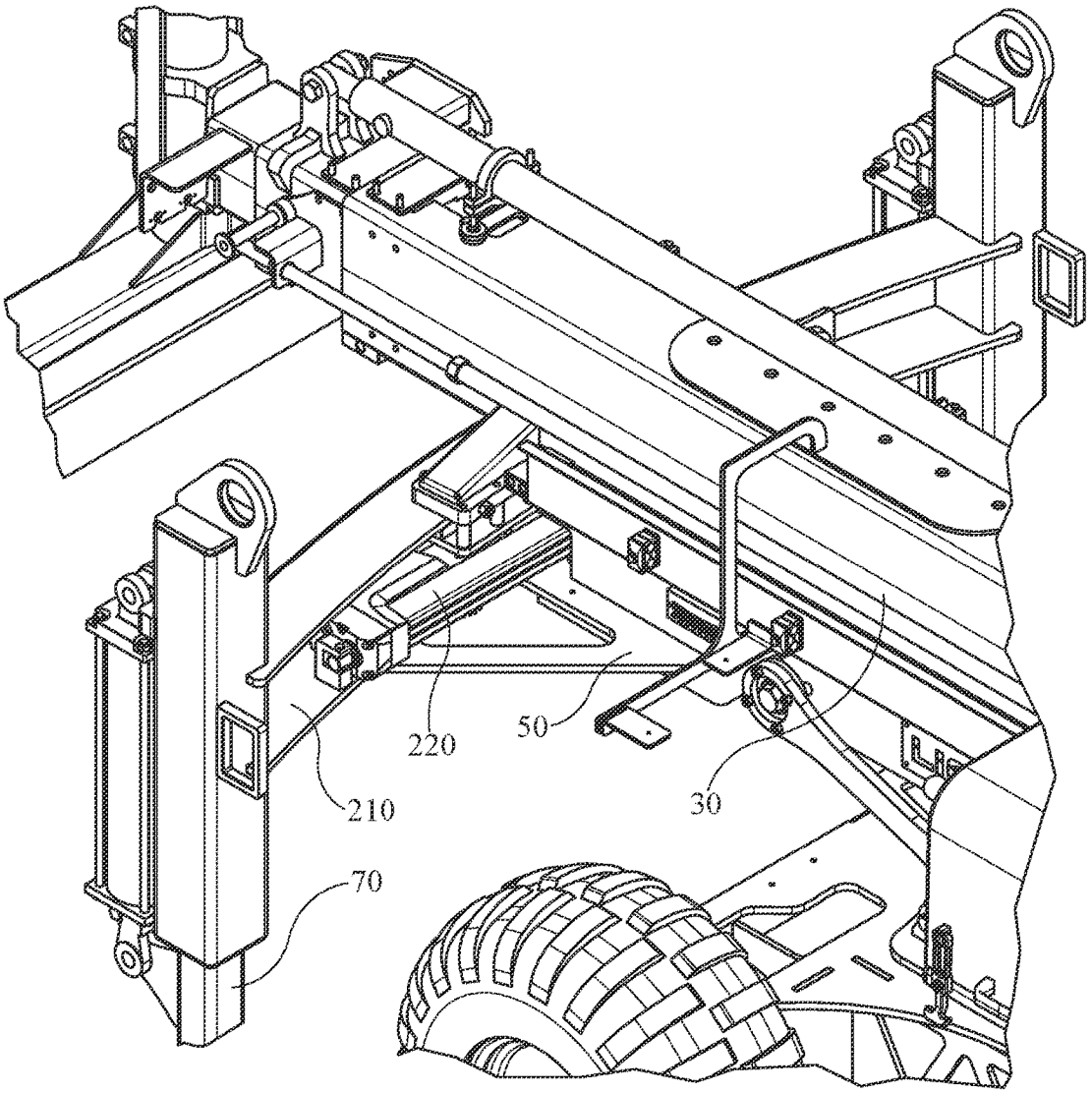
FIG. 7 is a detail view of a concrete screeding apparatus in accordance with one embodiment of the present invention.
Figure 8:
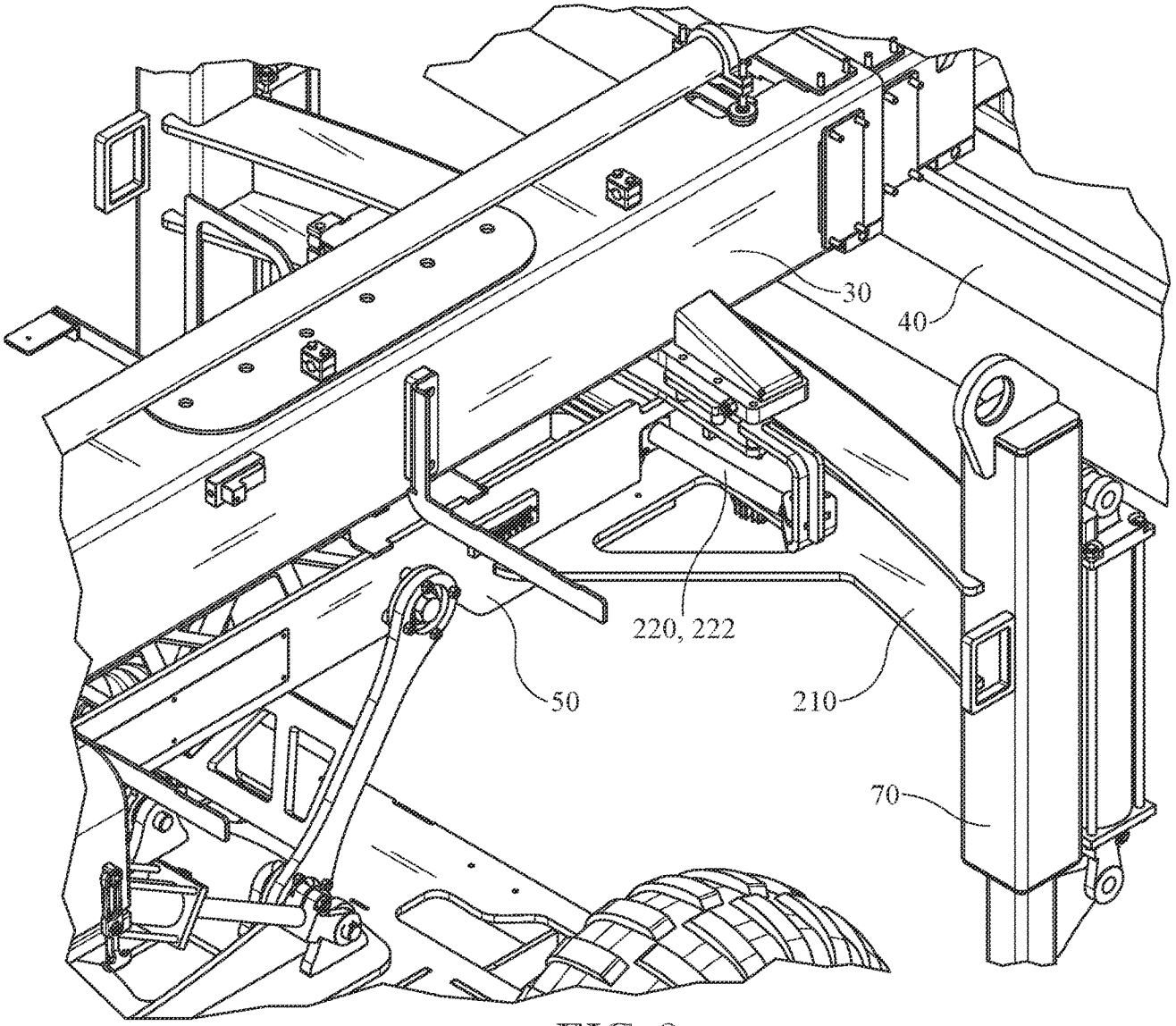
FIG. 8 is a detail view of a concrete screeding apparatus in accordance with one embodiment of the present invention.

FIGS. 3-8 further depict a side-step system 200 disposed at front end 51 of screed apparatus 10. Frame 50 of apparatus 10 includes a generally horizontally oriented front member 210 to which an opposed pair of leveling legs 70 are secured at either end thereof. As best seen in FIGS. 3 and 4, which depict front member 210 is secured at either end to leveling legs 70. Thus in the embodiments depicted in the drawing Figures the three leveling legs 70 function to level the entire apparatus, including frame 50, boom 30 and screed head 40, which is secured to a terminal end of boom 30.

In the disclosed embodiments boom 30 is adjustably or slidably mounted to move laterally or generally horizontally across an upper surface of front member 210 relative to frame 50. In some aspects and embodiments and as depicted in, for example, FIGS. 3, 7 and 8, front member 210 is slightly arcuate in shape, so that as boom 30 slides laterally across front member 210 screed head 40 moves in a slight arc. In some embodiments, front member 210 may be a relatively straight member 210 without departing from the scope of the invention.

In some embodiments boom 30, and thus screed head 40 may be moved laterally across front member 210 by operation of an actuator 220 that is secured to frame 50 at a point, and to boom 30 via a bracket, flange, or similar structure. Actuator 220 includes an extendable and retractable arm or link 222 that is secured to boom 30 and that, when actuated, operates to move boom 30, and thus screed head 40 side to side depending upon whether link 22 is being extended or retracted. Actuator 220 may be a linear actuator, hydraulic actuator, or any known actuating mechanism capable of imparting lateral relative motion between frame 50 and boom 30.

Additionally, actuator 220 may be operatively coupled to an operator interface to control the motion of boom 30 and screed head 40. In some embodiments operator interface may be a touch screen, switch, joystick, or other operator-controlled input device, that may in turn be operatively coupled to a hydraulic valve, or an electrical output for controlling actuator 220. In this fashion when an obstacle such as a column is encountered during screeding, an operator can use the operator interface to move screed head 40 to one side or the other to avoid the obstacle without the necessity of moving the entire screeding apparatus 10.

In accordance with various aspects of the invention, in operation boom 30 and thus screed head 40 may be pivoted around rear leg 70 by operation of actuator 220 to move screed head 40 around an obstacle or fixed object in the screed path. This feature of the invention provides the capability to screed around an obstacle while maintaining an extremely even grade surface without having to move screed apparatus 10 by operation of drive assembly 100. Thus the invention provides an enormous time and labor savings over the life of the screed apparatus 10 since hand screeding work by an operator is minimized for each concrete pour.

One of ordinary skill in the art will understand that although some exemplary embodiments of screeder 10 utilize a boom-type screed device, the various teachings and features of side-step assembly 200 disclosed herein may be employed with a variety of different screed types without departing from the scope of the present invention.

While a variety of inventive embodiments have been described and illustrated herein, those of ordinary skill in the art will understand that a variety of other methods, systems, and/or structures for performing the function and/or obtaining the results, and/or one or more of the advantages described herein are possible, and further understand that each of such variations and/or modifications is within the scope of the inventive embodiments described herein. Those skilled in the art will understand that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03. It should be understood that certain expressions and reference signs used in the claims pursuant to Rule 6.2(b) of the Patent Cooperation Treaty ("PCT") do not limit the scope While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention, as set forth in the claims appended hereto.

I claim:

1. An apparatus for screeding concrete to produce a level finished surface comprising:

a frame assembly having a front end and rear end, said frame assembly having a pair of spaced vertically oriented stabilization legs secured to the front end thereof, said spaced legs supporting a generally horizontal front member therebetween;

an extendable boom assembly secured to said frame assembly at a first end and to a screed head at a second end, said extendable boom assembly adjustably disposed on said front member; and a side-step assembly having an actuator with an extendable arm thereon, said actuator secured at a point to said frame, and said extendable arm secured to said boom assembly to impart generally lateral motion thereto.

2. An apparatus as claimed in claim 1 wherein said actuator is an hydraulic actuator.

3. An apparatus as claimed in claim 1 wherein said actuator is a linear actuator.

4. An apparatus as claimed in claim 1 comprising:

a vertically oriented stabilization leg secured to said frame assembly at said rear end thereof, whereby said stabilization legs level said frame and said screed head.

* * * * *